United States Patent [19]

Takeda et al.

[11] Patent Number: 5,050,249

[45] Date of Patent: Sep. 24, 1991

[54] HUMAN PRIVATE PARTS WASHING APPARATUS

[75] Inventors: Hisanobu Takeda, Aichi; Tomio Oguma, Anjo, both of Japan

[73] Assignee: Aisin Seiki Kabushiki Kaisha, Kariya, Japan

[21] Appl. No.: 560,288

[22] Filed: Jul. 30, 1990

Related U.S. Application Data

[63] Continuation of Ser. No. 196,430, May 29, 1990, abandoned.

[30] Foreign Application Priority Data

May 28, 1987 [JP] Japan ..... 62-132931
May 29, 1987 [JP] Japan ..... 62-136409
Aug. 30, 1987 [JP] Japan ..... 62-217034

[51] Int. Cl.[5] ..... A47K 3/22; A61H 35/00

[52] U.S. Cl. ..... 4/443; 4/420.4; 4/448

[58] Field of Search ..... 4/420.4, 420.5

[56] References Cited

U.S. PATENT DOCUMENTS 4,761,837 8/1988 Takeda ..... 4/443
4,841,582 6/1989 Matsui et al. ..... 4/448

FOREIGN PATENT DOCUMENTS 62-13450 3/1987 Japan .
62-13451 3/1987 Japan .

*Primary Examiner*—Henry J. Recla
*Assistant Examiner*—David J. Walczak
*Attorney, Agent, or Firm*—Oblon, Spivak, McClelland, Maier & Neustadt

[57] ABSTRACT

A human private parts washing apparatus according to this invention is provided with the following: a new washing water splashing means comprising a nozzle supporter, a washing nozzle and a washing water supply tube, which is extending in the washing nozzle in a manner with one end protruding in the washing nozzle, and supplies the washing water to the washing nozzle and makes up the washing nozzle advancement at the same time; a newly arranged washing nozzle driving means comprising a fixed rack formed on a nozzle supporter, a movable rack formed on a washing nozzle in a manner parallelly facing the fixed rack and a pinion meshing the fixed rack and the movable rack; a washing nozzle comprising an outer nozzle operated slidably back and forth with a washing nozzle driving means and an inner nozzle operated slidably with a hydraulic pressure of the supplied washing water; and an auxiliary washing nozzle driving means aiding a washing nozzle driving means to operate the washing nozzle over an additional stroke. Thus, the washing water is supplied independent of the washing nozzle's operation positions; the washing nozzle reaches the bidet washing position ahead of the anus region washing positon by 30 to 35 mm without any trouble; and the washing nozzle can be advanced and retracted by 10 to 30 mm additionally with respect to the bidet washing position.

8 Claims, 12 Drawing Sheets

HUMAN PRIVATE PARTS WASHING APPARATUS

This application is a continuation of application Ser. No. 07/196,430 , filed on 05/29/90, now abandoned.

BACKGROUND OF THE INVENTION

1. Field of the Invention

This invention relates to a human private parts washing apparatus installed to a toilet bowl.

2. Discussion of the Background

A washing apparatus disclosed in Japanese Examined Patent Application (KOKOKU) No. 13450/1987 has been known as one of the the washing apparatuses of this type. This conventional washing apparatus will be hereinafter described with reference to FIG. 14. The drawing mainly illustrates a washing nozzle driven by a motor. A nozzle supporter is designated at 10, and installed on the top of a toilet bowl 1 at the rear, and disposed in an enclosure 3. A washing nozzle is designated at 20, and is held in the nozzle supporter 10. The washing nozzle 20 is supported in the nozzle supporting bore 11' slidably back and forth in a forward inclining manner toward the toilet bowl 1 inside.

The washing nozzle 20 has a channel 49 inside thereof, an inlet opening 50 at the rear end thereof and splashing openings 22 on the top at the front end thereof. The nozzle supporter 10 has an annular concave 52 sealed in a water-proof manner with O-rings 51 and connected to a channel 53. The annular concave 52 is formed in the nozzle supporting bore 11', and the channel 53 is connected to a washing water supply source (not shown).

A flexible driving member 131' is fixed to a rotary drum 130 at one end thereof, and to the rear end of the washing nozzle 20 at the other end thereof. The rotary drum 130 is fixed to a motor shaft 33' of a motor (not shown). The flexible driving member 131' is guided in a guide track 132 formed in the nozzle supporter 10, and advances and retracts the washing nozzle 20 in the nozzle supporting bore 11' by a predetermined distance as the motor turns the rotary drum 130. As the flexible driving member 131', a flat spring is proposed in Japanese Examined Patent Application (KOKOKU) No. 13451/1987.

When the splashing openings 22 of the washing nozzle 20 reaches a washing position, the inlet opening 50 communicates with the annular portion 52 to introduce washing water, and washing is performed. In FIG. 14, alternate long and two dashes line "E" shows a contour of a human body when a user sits on a toilet seat. An anus region washing position is designated at "D", and a bidet washing position is designated at "F".

However, the conventional washing apparatus described above has the following problems:

A user cannot adjust the operation positions of the washing nozzle 20 to one's desired positions when the operation positions are not one's desired positions, since the operation positions of the washing nozzle 20 is limited by the position of the annular concave 52 formed in the nozzle supporter 10. In addition, the limitation makes impossible an additional back and forth sliding washing preferable for the bidet washing;

As described above, the conventional washing apparatus employs the flexible driving member 131', i.e. a flat spring, for operating the washing nozzle 20 back and forth. The flexibility of the flat spring is an important functional factor, and a relatively thin flat spring is employed since it should be accommodated in a limited space. The flat spring works smoothly, and is preferable under an ordinary condition. However, when the washing nozzle 20 is stopped by a sudden blackout, and the toilet apparatus is used afterward, the washing nozzle 20 will be contaminated with filth if it is left in the toilet bowl 1 in a protruding manner. The washing nozzle 20 may be pushed backward to its storage position manually to avoid the contamination. But the pushing force is applied to a speed reducer of the motor through the flat spring and the rotary drum 130. As a result, the flat spring is deformed inevitably in the guide track 132 and a clearance between the rotary drum 130 and the nozzle supporter 10. The flat spring may be permanently deformed, and the washing nozzle 20 may not be operated in the next usage;

The rotary drum 130 and the washing nozzle 20 are disposed adjacent each other and the guide track 132 is formed in a relatively small radius of curvature in order to make the washing nozzle guide portion compact. Accordingly, especially when the washing nozzle advances, the sliding friction force increases, and the output of the motor should inevitably be set greater. Here, the sliding force is a resultant force of the sliding friction force exerted between the flat spring and the guide track 132, and the sliding friction force exerted between the washing nozzle 20 and the nozzle supporting bore 11'; and As can be seen from FIG. 13, the washing apparatus 54 cannot have a large dimension in the lateral direction, since a washing water supply tank 55 is provided in the rear. Thus, a sufficient advance and retract stroke is not available for the washing nozzle 20. However, regarding a proper washing, it is preferred to splash the washing water at an elevation angle of 70 deg. with respect to human private parts to be washed. Considering this condition, the anus region washing can be done, but the bidet washing can hardly be done with the conventional washing apparatus. This is because the washing nozzle 20 cannot advance and retract by a sufficient stroke as mentioned earlier so that the bidet washing cannot be done at a preferred position, i.e., the bidet washing should preferably be done at a position by 30 to 35 mm ahead of the anus region washing position at an elevation angle of 70 deg.

SUMMARY OF THE INVENTION

It is an object of this invention to enable an easy adjustment of the washing nozzle operation positions with a simple arrangement.

Another object of this invention is to provide a washing nozzle driving means having a good durability and less susceptible to an accident like blackout.

A further object of this invention is to solve the improper bidet washing mentioned above by sliding the washing nozzle back and forth over an additional stroke of 10 to 30 mm with respect to the bidet washing position while splashing the washing water.

The above objects have been achieved and any human private parts can be washed satisfactorily at a user's disposal in accordance with this invention:

A new washing splashing means is devised in this invention. It comprises a nozzle support, a washing nozzle and a washing water supply tube. A major feature of the new washing water splashing means is the washing water supply tube. The washing water supply tube is extending in the washing nozzle in a manner with one end protruding in the washing nozzle, and supplies the washing water to the washing nozzle and makes up the washing nozzle advancement at the same time. Thus, the washing water is supplied independent of the washing nozzle's operation positions through the washing water supply tube;

A washing nozzle driving means of this invention is provided with a new arrangement: a fixed rack formed on a nozzle supporter, a movable rack formed on a washing nozzle in a manner parallelly facing the fixed rack and a pinion meshing the fixed rack and the movable rack. When the pinion is turned, the pinion advances over the fixed rack while meshing with the fixed rack, and then the movable rack, meshing also with the pinion, advances. Consequently, the washing nozzle advance and is stopped with a control means when it reaches a predetermined position. Thus, the washing nozzle advances twice the movement of the pinion in this washing nozzle driving means.

Further, in this invention, a washing nozzle comprises an outer nozzle operated slidably back and forth with a washing nozzle driving means and an inner nozzle operated slidably with a hydraulic pressure of the supplied washing water in accordance with an instruction from a control means. When an instruction of a washing operation is given by a control means, the washing nozzle driving means is activated to advance the outer nozzle. After the outer nozzle is fully advanced, the inner nozzle is advanced with the hydraulic pressure increased in accordance with an instruction from the control means. Thus, the washing nozzle reaches the bidet washing position, and splashes the washing water at the bidet washing position ahead of the anus region washing position by 30 to 35 mm. Here, the outer nozzle advancement is a first-stage advancement of the washing nozzle, and the inner nozzle advancement is a second-stage advancement of the washing nozzle; and Furthermore, in this invention, the washing nozzle is operated by an additional stroke with a washing nozzle driving means with an aid of an auxiliary washing nozzle driving means. The auxiliary washing nozzle driving means may be reed switches or a combination of a cam and snap-acition switches. In a preferred embodiment of this invention, a reed switch is disposed on a nozzle support plate at a first position corresponding the first-advancement position, i.e. the anus region washing position, and another reed switch is disposed on the nozzle plate at a second position corresponding the end of an additional stroke, i.e. a position ahead of the bidet washing position by 10 to 30 mm, and a magnet is disposed in the outer rim of the washing nozzle adjacent the end thereof. Thus, after the first-stage advancement of the washing nozzle is operated with the washing nozzle driving means and the second-stage advancement of the washing nozzle is operated with the hydraulic pressure of the supplied washing water, the washing nozzle can be advanced and retracted additionally with respect to the bidet washing position slidably over the additional stroke of 10 to 30 mm with the washing nozzle driving means by alternately activating and deactivating the reed switches.

The invention thus constructed offers the following advantages:

The washing water can be supplied independent of the positions of the advancing and retracting washing nozzle, since the washing water is supplied through the washing water supply tube inserted into the washing nozzle. Accordingly, the washing water splashing position can be adjusted easily so that it is possible to make a fine adjustment of the human private parts washing positions depending on where a user sits on the toilet seat;

The radial run-out of the washing nozzle in operation can be prevented, since the washing nozzle is guided with the washing water supply tube;

The movable rack of the washing nozzle does not protrude into the toilet bowl when the arrangement of the movable rack, the fixed rack and the pinion according to this invention is employed for a washing nozzle driving means, since it is necessary to form the movable rack having a length only by a half of the traveling stroke of the washing nozzle;

The arrangement of the movable rack, the fixed rack and the pinion according to this invention is free from the drawbacks associating with the washing apparatuses disclosed in Japanese Examined Patent Applications (KOKOKU) No. 13450/1987 and No. 13451/1987: the increased frictional force due to the flat spring sliding in the guide track and the deformed flat spring in the guide track due to the manual adjustment of the operation positions of the washing nozzle. In addition, the washing nozzle responds to the instruction from the control means well, since it is operated slidably with the arrangement of the movable rack, the fixed rack and the pinion;

A longer advancement and retraction stroke is available in a confined space of a washing apparatus when the combination of the outer nozzle operated with the washing nozzle driving means and the inner nozzle operated with the hydraulic pressure of the supplied washing water according to this invention is employed. The longer advancement and retraction stroke has not been available from the conventional washing apparatus. Thus, it is possible to perform the bidet washing efficiently in the direct splashing manner, i.e. at an elevation angle of 70 deg. with respect to human private parts to be washed; and It is possible to perform the bidet washing with back and forth movement over an additional stroke, since the washing nozzle can be operated slidably by an additional stroke when the auxiliary washing nozzle control means according to this invention is employed. Thus, the effect and feeling of the bidet washing is improved.

BRIEF DESCRIPTION OF THE DRAWINGS

FIGS. 8 through 11 illustrate a fourth preferred embodiment employing a washing nozzle, comprising an outer nozzle operated with a washing nozzle driving means and an inner nozzle operated with a hydraulic pressure of the supplied washing water, according to this invention in which:

FIG. 8 is a cross sectional view illustrating that the washing nozzle is in its storage position;

FIG. 9 is a cross sectional view illustrating that the washing nozzle is operated to its first-stage advancement, i.e., a standby position for the bidet washing; and FIG. 10 is a cross sectional view illustrating that the washing nozzle is operated to its second-stage advancement, i.e. the bidet washing position;

FIG. 11 is a cross sectional view illustrating that the washing nozzle is advanced and retracted over an additional stroke with respect to the second-stage advancement, i.e. the bidet washing position.

DETAILED DESCRIPTION OF THE PREFERRED EMBODIMENTS

First Preferred Embodiment

The first preferred embodiment of this invention will be hereinafter described.

Figure 1:
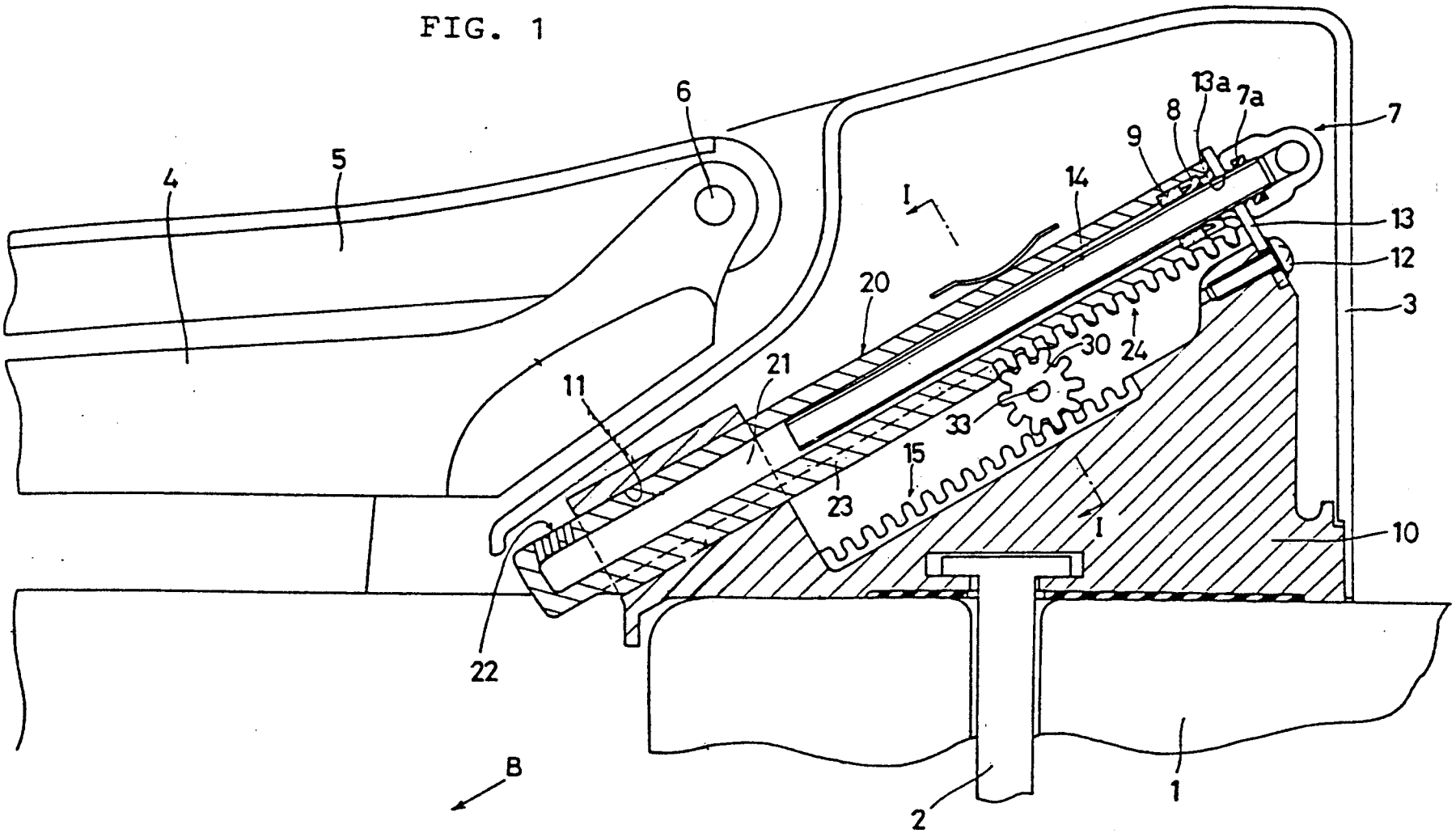
FIG. 1 is a cross sectional view of a first preferred embodiment employing a rack and pinion mechanism as the washing nozzle driving means and a washing water supply tube according to this invention.
Figure 2:
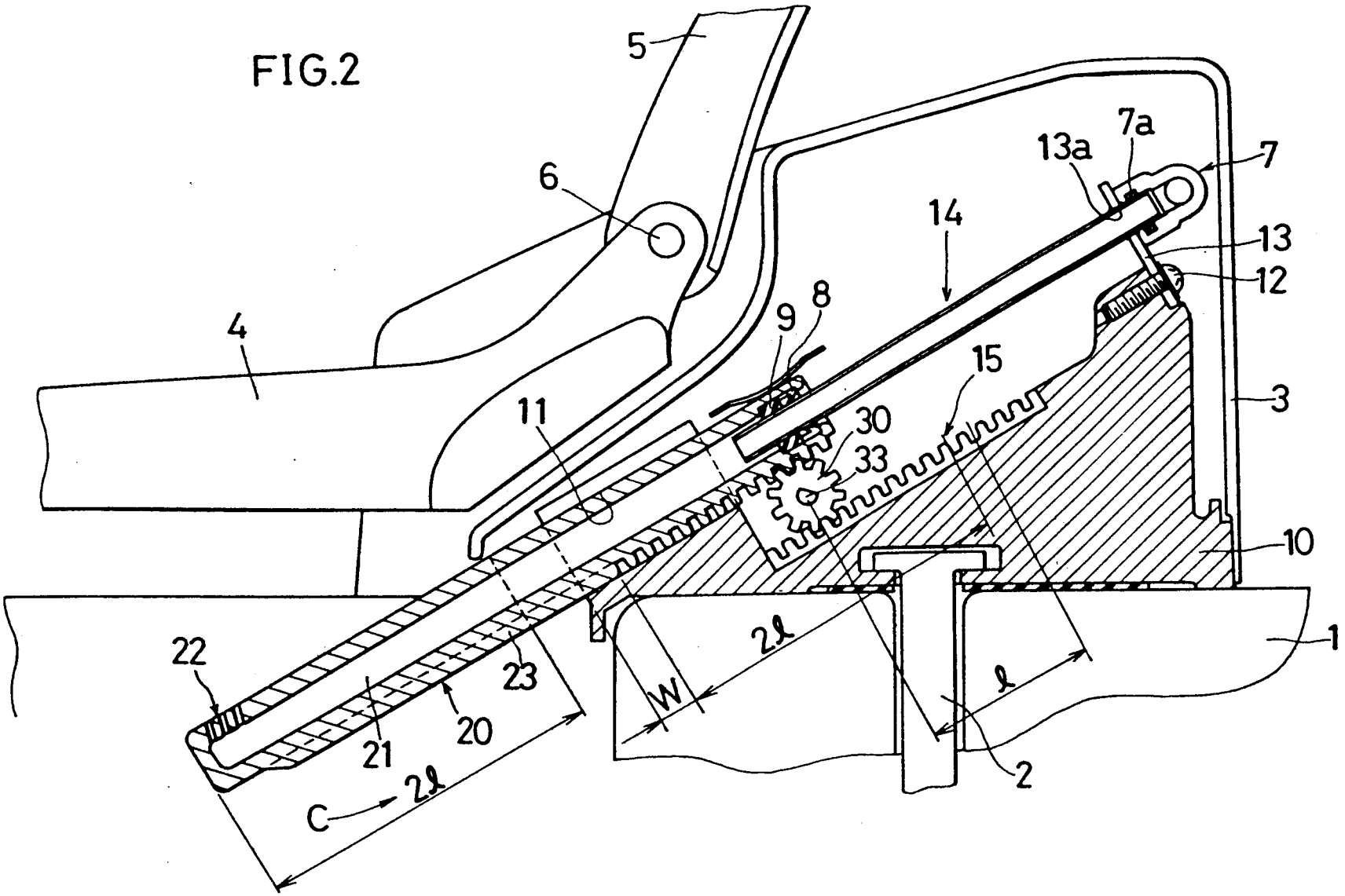
FIG. 2 is a cross sectional view of the first preferred embodiment in which a washing nozzle is advanced to a washing position.

As illustrated in FIGS. 1 and 2, a nozzle supporter 10 is fixed on the top of a toilet bowl 1 at the rear with a bolt 2. An enclosure 3 having an opening at the front is disposed on the top of the toilet bowl 1, and covers the nozzle supporter 10 in a water-proof manner. The enclosure 3 is provided with a toilet seat 4 and a toilet cover 5 held rotatably with a pin 6.

A nozzle guide bore 11 is formed at the front of the nozzle supporter 10, and is directed in a forward inclining manner toward the toilet bowl 1 inside. In the nozzle guide bore 11, a washing nozzle 20 is held in a concentric manner with the nozzle guide bore 11, and protrudes out of the opening of the enclosure 3. Thus, the washing nozzle 20 advances and retracts slidably to and from the storage position and the human private parts washing positions. A channel 21 closed at one end and having an opening at the other end is formed in the washing nozzle 20. Splashing openings 22 are so formed adjacent the closed end of the channel 21 that they splash the washing water in the directions of human private parts when the washing nozzle 20 is at the operation positions.

A support plate 13 is fixed to the nozzle supporter 10 at the rear with a screw 12. The support plate 13 has a hole 13*a* through which a washing water supply tube 14 is held in a concentric manner with the washing nozzle 20. The washing water supply tube 14 is inserted into the channel 21 of the washing nozzle 20, and is extending so as to make up the advancement of the washing nozzle 20 depending on the operation positions. The washing water supply tube 14 also works to guide the washing nozzle 20. The washing water supply tube 14 has openings at the both ends, and one end is disposed in the channel 21, and the other end is fitted with an O-ring 7*a* and joined to a washing water supply pipe 7 communicating with a washing water supply source (not shown).

A sliding seal 8 is disposed between the washing water supply tube 14 and the washing nozzle 20 to seal between them in a water-proof manner, and fixed on the inner wall of the washing nozzle 20. And a guide ring 9 is fixed on the inner wall of the washing nozzle 20 to maintain the concentricity between the washing water supply tube 14 and the washing nozzle 20 while the washing nozzle 20 is operating. The sliding seal 8 decreases the frictional resistance between the washing water supply tube 14 and the washing nozzle 20 when the washing nozzle 20 slides. Consequently, it is possible to produce the washing nozzle 20 with less cost but with a wide variety of appearance, since no treatment is required to reduce the frictional resistance of the washing nozzle 20 outer surface.

A flange 23 is formed in the bottom of the washing nozzle 20 substantially over the full length thereof. And a movable rack 24 is formed in a portion of the flange 23 at the rear. Further, a fixed rack 15 is formed in the top surface of the nozzle supporter 10 facing the movable rack 24 in a parallel manner therewith. And a pinion 30 is disposed between the movable rack 24 and the fixed rack 15. The pinion 30 always meshes with the movable rack 24 and the fixed rack 15, and rolls over the fixed rack 15.

Figure 3:
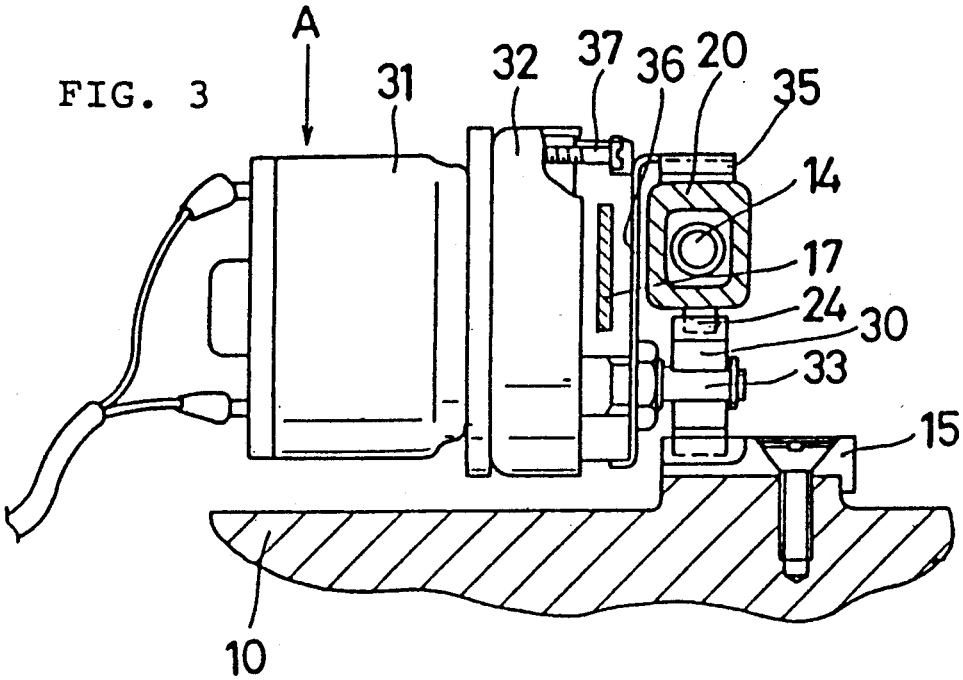
FIG. 3 is a cross sectional view taken along line I—I of FIG. 1.
Figure 4:
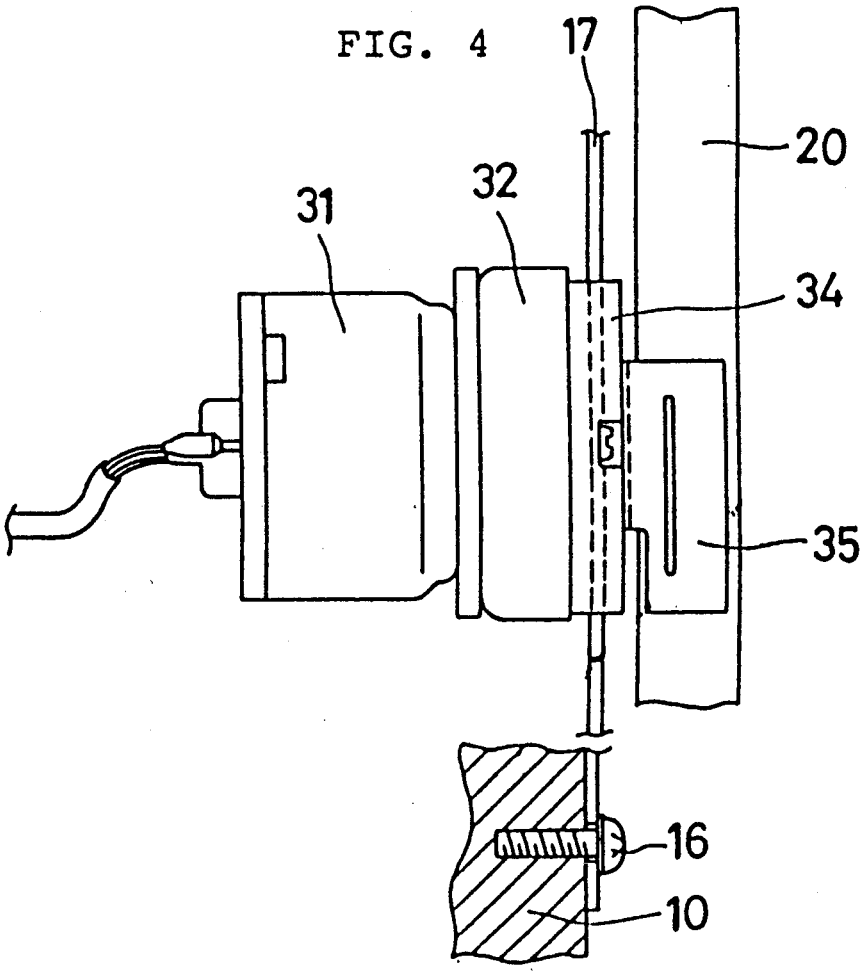
FIG. 4 is a view taken in the direction of the arrow "A" of FIG. 3.

Turning now to FIGS. 3 and 4, the pinion 30 is fixed rotatably to a shaft 33 of a speed reducer 32 integral with a motor 31, and a guide bracket 34 is fixed to the motor 31 with a screw 37. The motor 31 is held slidably via the guide bracket 34 along a guide plate 17 which is installed in the guide track 34*a*, and moves with the washing nozzle 20. The guide plate 17 is fixed to the nozzle supporter 10 with screws 16. A retainer spring 35 is disposed in contact with the top surface of the washing nozzle 20, and fixed to the motor 31 with a bracket 36. The retainer spring 35 opposes the force pushing the washing nozzle 20 upward, exerted when the motor 31 operates, and always presses the washing nozzle 20 toward the pinion 30 so as not to disengage the pinion 30 and the movable rack 24.

The operation of the first preferred embodiment will be hereinafter described. Turning back to FIG. 1, the washing nozzle 20 is at the storage position in the drawing. When the motor 31 is operated to turn the pinion 30 in the counterclockwise direction in the drawing, the pinion 30 rolls over the fixed rack 15 in the direction of the arrow "B", and moves the movable rack 24 also in the direction. Thus, the motor 31 moves along the guide plate 17 in the direction, and the washing nozzle 20 slides also along the guide plate 17 in the direction while guided with the nozzle guide bore 11 and the washing water supply tube 14. When the washing nozzle 20 reaches an operation position, the washing nozzle 20 is stopped at an operation position as shown in FIG. 2 by a control means (not shown).

When the washing nozzle 20 is placed at the operation position in FIG. 2, the washing water delivered from the washing water supply source flows in the channel 21 by way of the washing water supply pipe 7 and the washing water supply tube 14, and splashes out of the splashing openings 22 to wash human private parts. If human private parts are situated away from the operation position where the splashing has taken place, the motor 31 is operated to adjust the position of the washing nozzle 20 to splash the washing water right at the human private parts. After the washing operation, the motor 31 is operated to turn the pinion 30 in the clockwise direction in FIG. 2, and the washing nozzle 20 slides backward in the direction of the arrow "C" in FIG. 2. Thus, the washing nozzle 20 is put back to the storage position shown in FIG. 1 from the operation position shown in FIG. 2.

In addition, as can be seen from FIG. 2, the washing nozzle 20 advances by 2 l with respect to the nozzle supporter 10 while the pinion 30 moves by l. Though the front end of the movable rack 24 advances by 2 l, it is enough to set an overall length of the movable rack 24 to l, i.e. a half of the advancement by 2 l. Therefore, there leaves an allowance of "W" so that the movable rack 24 is prevented from protruding into the toilet bowl 1 inside and being contaminated with human filth.

Comparative Example

Figure 5:
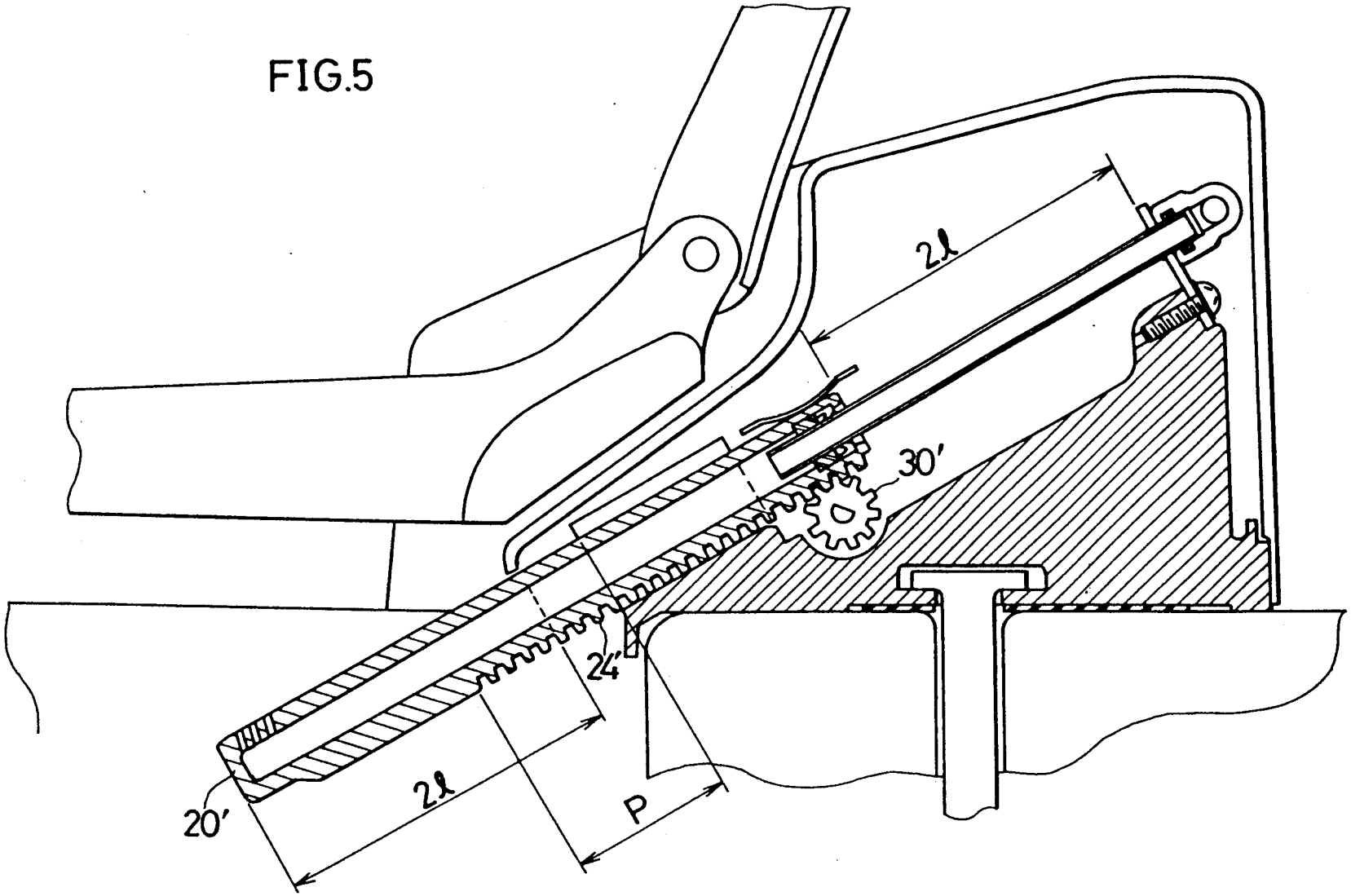
FIG. 5 is a cross sectional view of a comparative example employing another rack and pinion mechanism as the washing nozzle driving means intended to achieve an object of this invention.

A comparative example as shown in FIG. 5 may be intended to achieve an object of this invention. This comparative example employs a washing nozzle driving means including a fixed motor (not shown), a pinion 30' fixed to the motor shaft of the fixed motor, and rack 24' formed in the bottom of a washing nozzle 20' and meshing with the pinion 30'. In this comparative example, this simple rack and pinion mechanism advances and retracts the washing nozzle 20', however, the rack 24' of the washing nozzle 20' protrudes by "P" inside the toilet bowl when washing the human private parts. Accordingly, the rack 24' is contaminated with spilled human filth. And when the contaminated rack 24' of the washing nozzle 20' is stored, the rack 24' and the pinion 30' mesh improperly, so that they are likely to gall and operate abnormally. The spilled human filth will cause unpleasant smell and even adversely affect the cleanliness.

Second Preferred Embodiment

Figure 6:
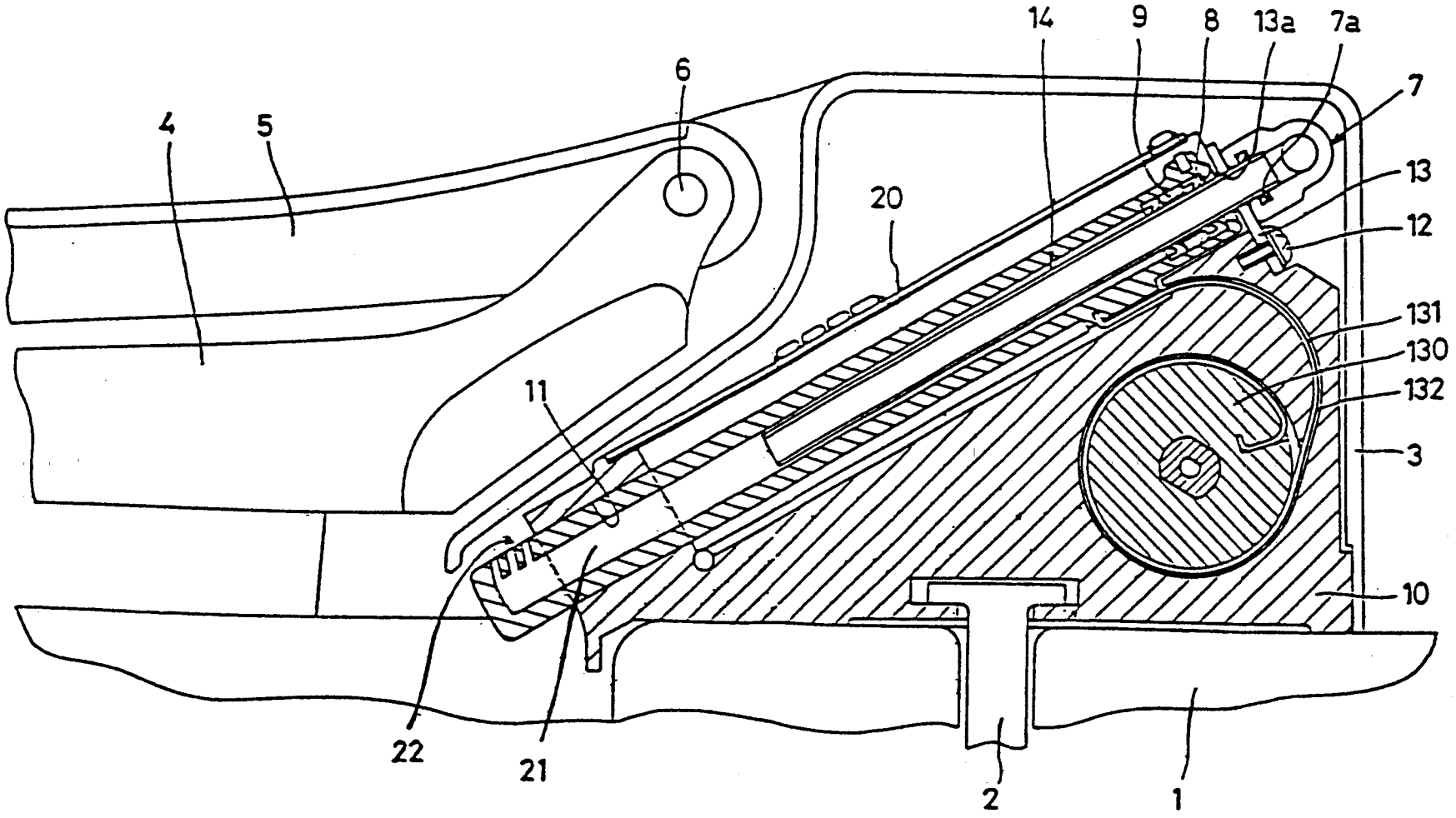
FIG. 6 is a cross sectional view of a second preferred embodiment employing still another washing nozzle driving means according to this invention.

The first preferred embodiment employing the rack and pinion mechanism as the washing nozzle driving means has been so far described, but this invention is not limited thereto. A second preferred embodiment employing another washing nozzle driving means is illustrated in FIG. 6. This preferred embodiment basically has the same arrangement of the first preferred embodiment, but employs another washing nozzle driving means: a cable 131, a rotary drum 130 and a motor (not shown). The cable 131 is disposed in the guide track 132 withits one end fixed to the washing nozzle 20 at the end, its other end fixed to the rotary drum 130, and wound around the rotary drum 130. And the rotary drum 130 is turned in both clockwise and counterclockwise directions with the motor (not shown). Thus, the cable 131 pushes and pulls a washing nozzle 20 to operate the washing nozzle 20 slidably between the storage position and the operation positions. Further, the washing nozzle driving means may be a combination of pin gear and gear, a combination of sprocket and chain, or friction gears if the slip is tolerable.

Third Preferred Embodiment

Figure 7:
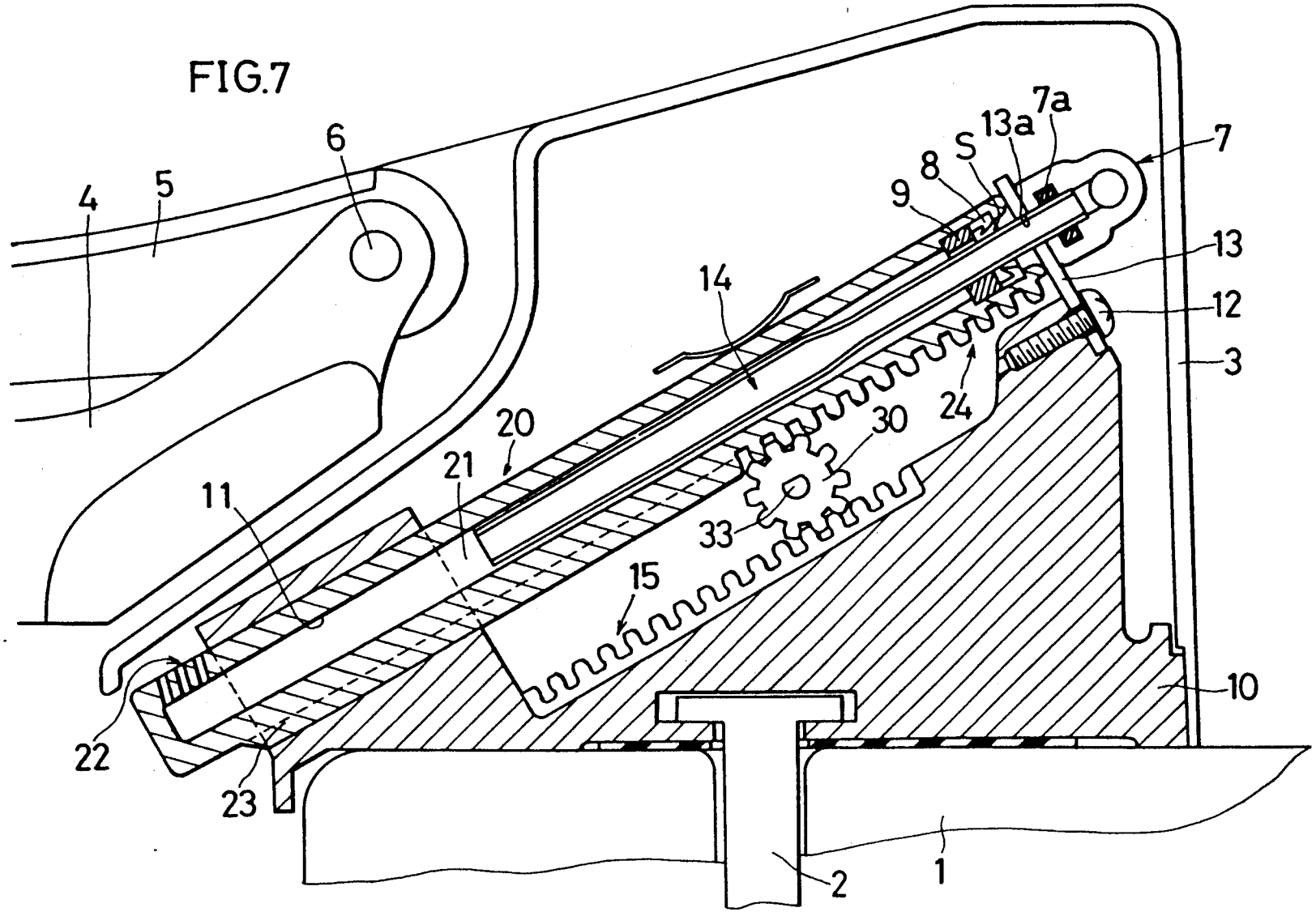
FIG. 7 is a cross sectional view of a third preferred embodiment employing another washing water supply tube according to this invention.

As illustrated in FIG. 7, this third preferred embodiment employs a washing water supply tube 14 having a reduced diameter at one end, other than this arrangement it has the same arrangement as that of the first preferred embodiment, for instance the rack and pinion mechanism and the like.

The washing water supply tube 14 is adapted to contact with the washing nozzle 20 in a water-proof manner with the sliding seal 8 when the washing nozzle 20 is at the operation positions. And it has a reduced diameter end to form a clearance "S" between itself and the sliding seal 8 when the washing nozzle 20 is at the storage position. The sliding seal 8 is fixed on the inner wall of the washing nozzle 20 as in the first preferred embodiment. Namely, the clearance "S" comes to be formed between the sliding seal 8 and the washing water supply tube 14 as the washing nozzle 20 retracts slidably to the storage position after washing the human private parts. Consequently, the channel 21 in the washing nozzle 20 communicates with the atmosphere, and the residual washing water in the channel 21 is discharged into the toilet bowl 1 out of the splashing openings 22 with the atmospheric pressure. Thus, this arrangement has done away with the unpleasant feeling in the re-use due to the cooled residual washing water.

Fourth Preferred Embodiment

An arrangement and operation of this fourth preferred embodiment will be described with reference to FIGS. 8 through 11. This preferred embodiment employs a washing nozzle comprising an outer nozzle operated with a washing nozzle driving means and an inner nozzle operated with a hydraulic pressure of the supplied washing water.

Figure 8:
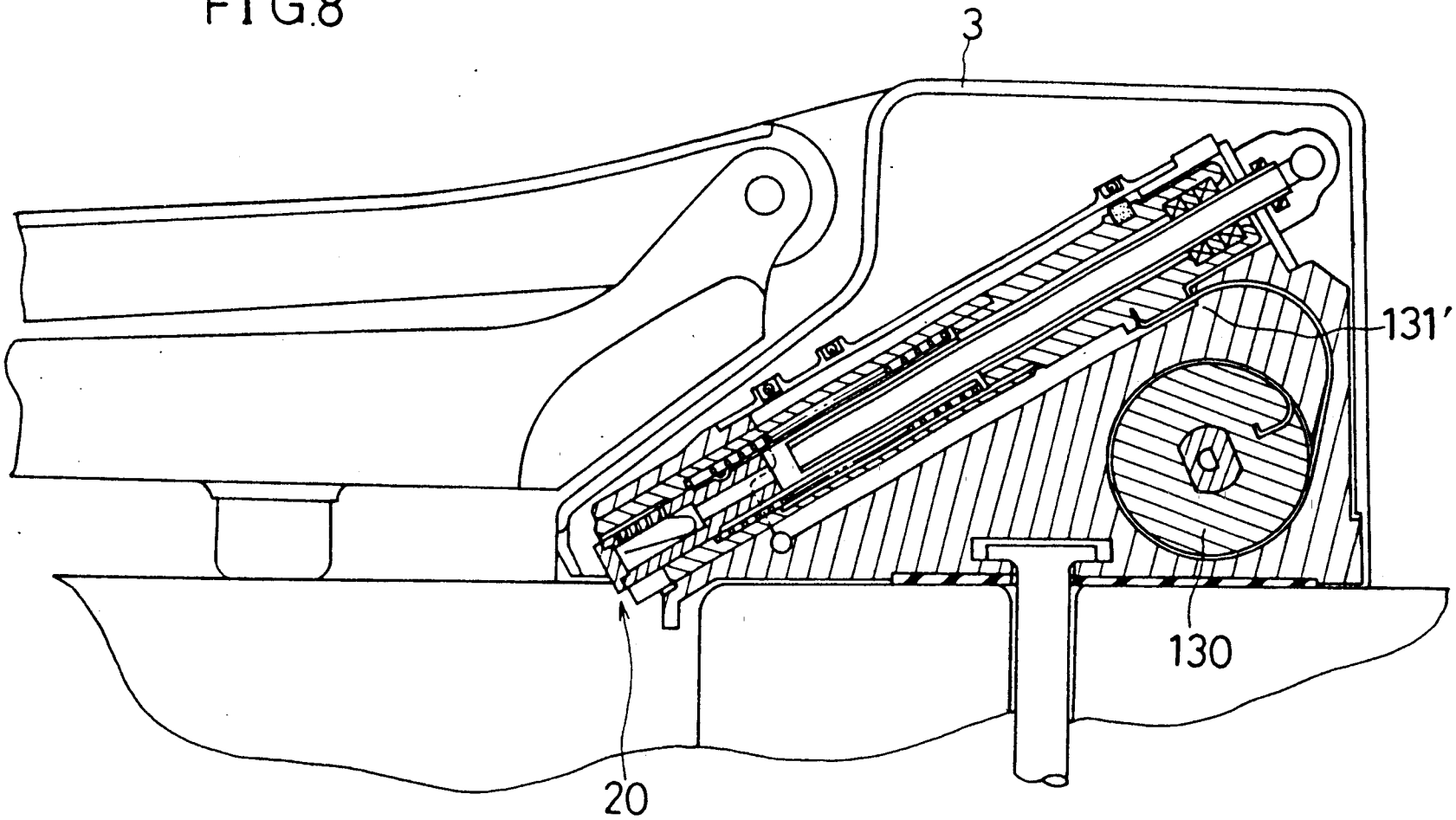

Referring now to FIG. 8, the drawing shows that the washing nozzle 20 is stored at the storage position in the enclosure 3. The washing nozzle 20 is advanced and retracted slidably with the cable 131' and the rotary drum 130 turned with a motor (not shown).

Figure 9:
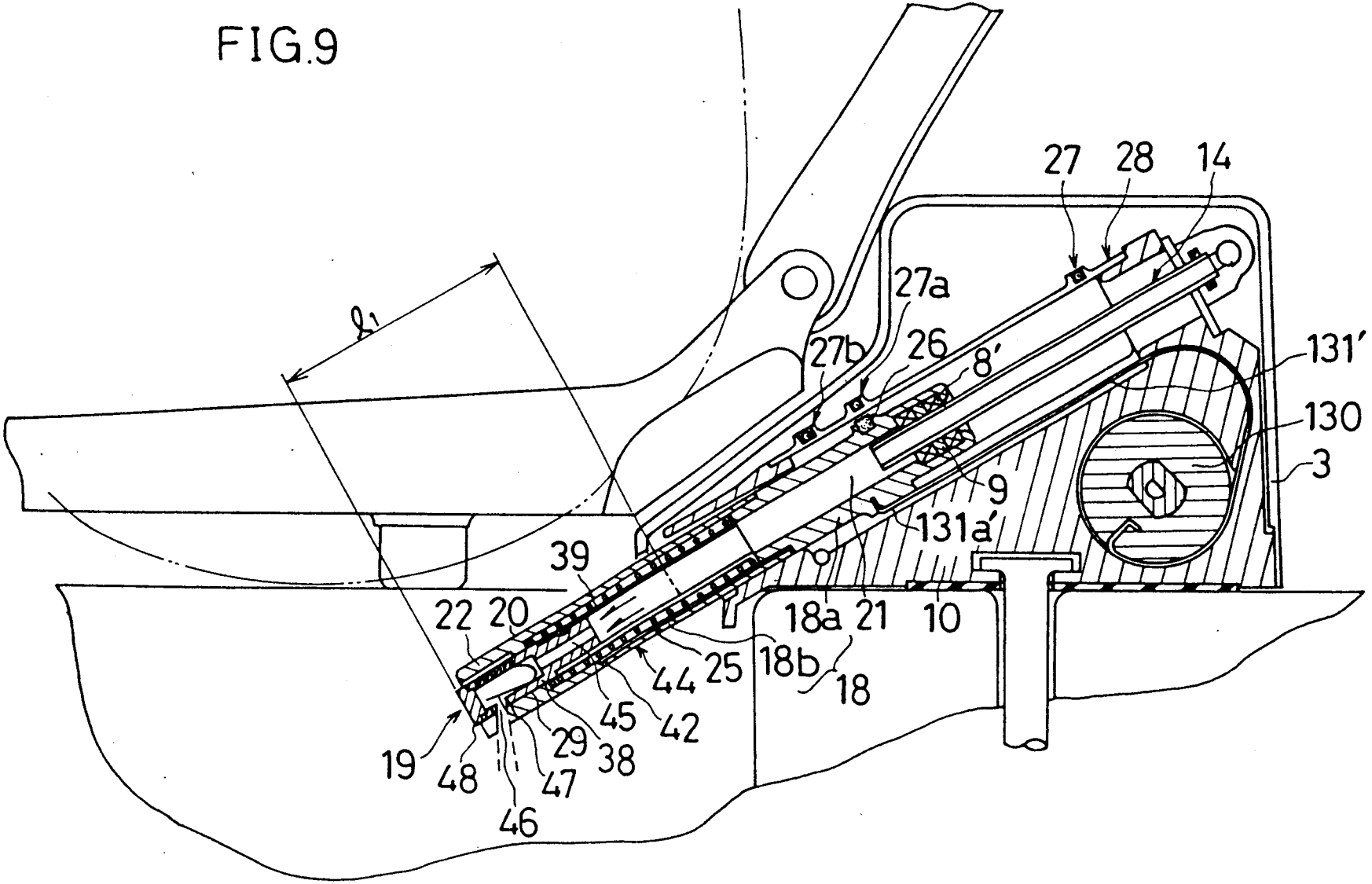

Turning now to FIG. 9, the figure shows that the washing nozzle RO is advanced by a stroke of $l_1$. When an instruction of washing operation is given through a control means (not shown), the washing nozzle 20 is advanced in a forward inclining manner as the cable 131' extends in accordance with the rotary drum 130 turned with the motor.

The washing nozzle 20 includes an outer nozzle 18 and an inner nozzle 19. The outer nozzle 18 includes a rear member **18*a* and a front member 18*b* joined together. A channel 21 and a spring chamber 25, having a larger inner diameter than the channel 21, are formed respectively in the rear member 18*a* and the front member 18*b*. And sealing members 8 and a guide ring 9 are fixed on the inner wall of the rear member 18*a* at the rear end, further a magnet 26 and the one end 131*a'* of the cable 131' are fixed on the outer wall of the rear member 18*a* adjacent the rear end. The front member 18*b* has an opening at the front end, and holds the outer wall of the inner nozzle 19** slidably back and forth with its inner wall.

The inner nozzle 19 includes a nozzle head 38 and a cylinder 39 joined together. A reduced diameter channel 45 is formed in the inner nozzle 19 to maintain the inner hydraulic pressure for pushing the inner nozzle 19 forward while the pressure of the supplied washing water is increasing. And it introduces the residual washing water to a discharge opening 46 when the washing apparatus is not used. A poppet member 47 is disposed in the inner nozzle 19 to open and close the discharge opening 46 depending on the pressure of the supplied washing water in order to discharge the cold residual water and minimize the washing water leakage. If desired, the reduced diameter channel 45 and the poppet member 47 may be replaced with a valve. Splashing openings 22 are so formed in the inner nozzle 19 that they direct the washing water to the human private parts when the washing nozzle 20 is in operation. And the inner nozzle 19 is plugged with a plug 48.

Figure 10:
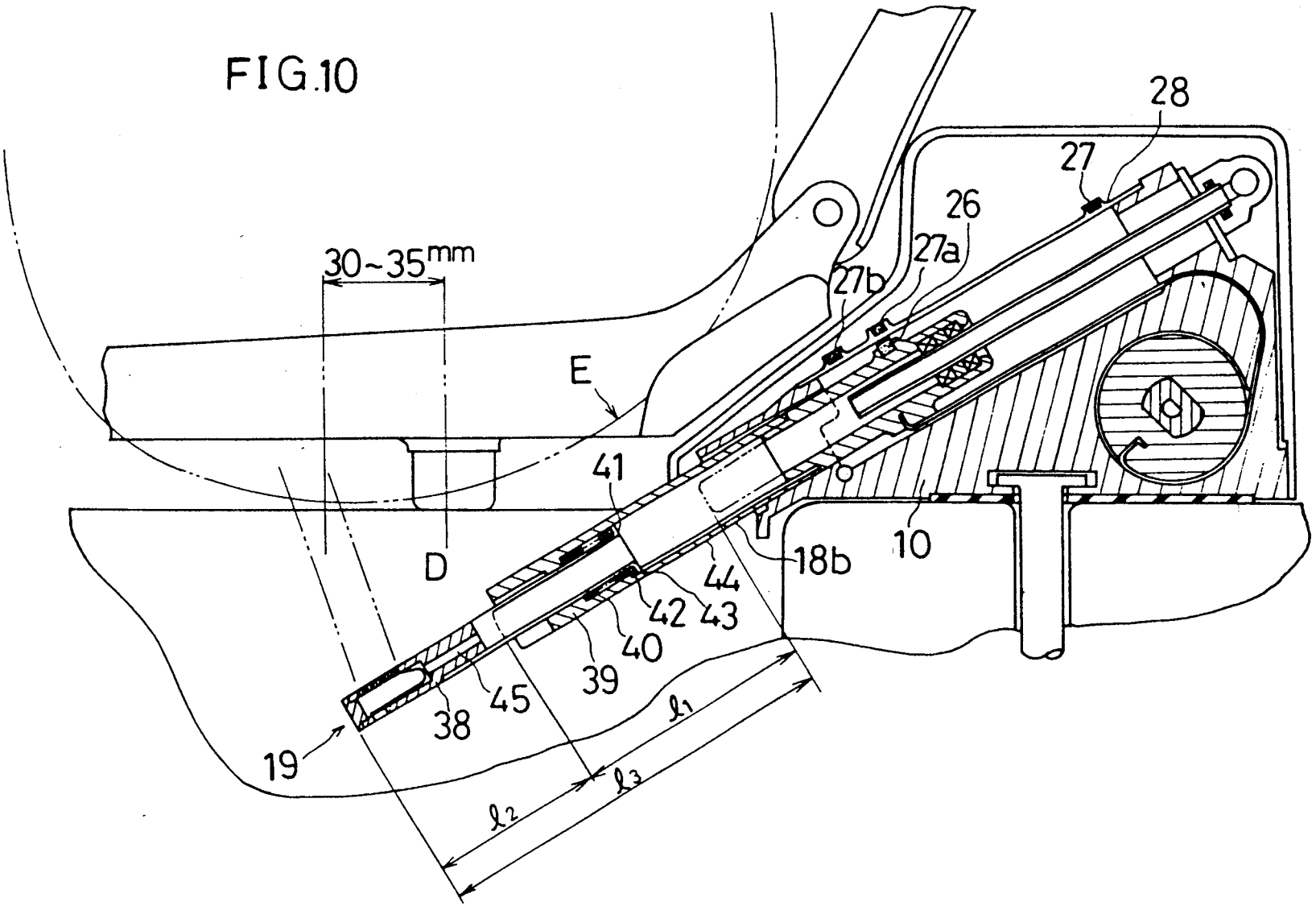

Thus, as the pressure of the supplied washing water increases, the inner nozzle 19 advances by a stroke of $l_2$ against the force of the return spring 40 from the state illustrated in FIG. 9 to the state illustrated in FIG. 10, i.e., the bidet washing position, and for most cases, the washing water is splashed by 30 to 35 mm ahead of the anus region washing position designated at "D" In the state illustrated in FIG. 10, the return spring 40 is fully pressed to minimize the clearance between a flange 41 of the cylinder 39 of the inner nozzle 19 and the shoulder 42 of the front member **18*b* of the outer nozzle 18 and avoid washing water leakage through the clearance. The flange 41 has a projection 43 on the outer rim. The projection 43 slidably engages a slide track 44 formed in the front member 18*b*, and works to position the nozzle head 38**.

Further, reed switches designated at 27, **27*a* and 27*b* are disposed on a nozzle support plate 28 over the nozzle supporter 10. They are provided to detect the positions of the washing nozzle 20 via the positions of the magnet 26, and the positions of the reed switches 27, 27*a* and 27*b* respectively correspond the storage position, the first-stage-advancement of the washing nozzle 20, i.e. the advancement of the outer nozzle 18** to a standby position for the bidet washing and the end of an additional stroke later described.

Figure 11:
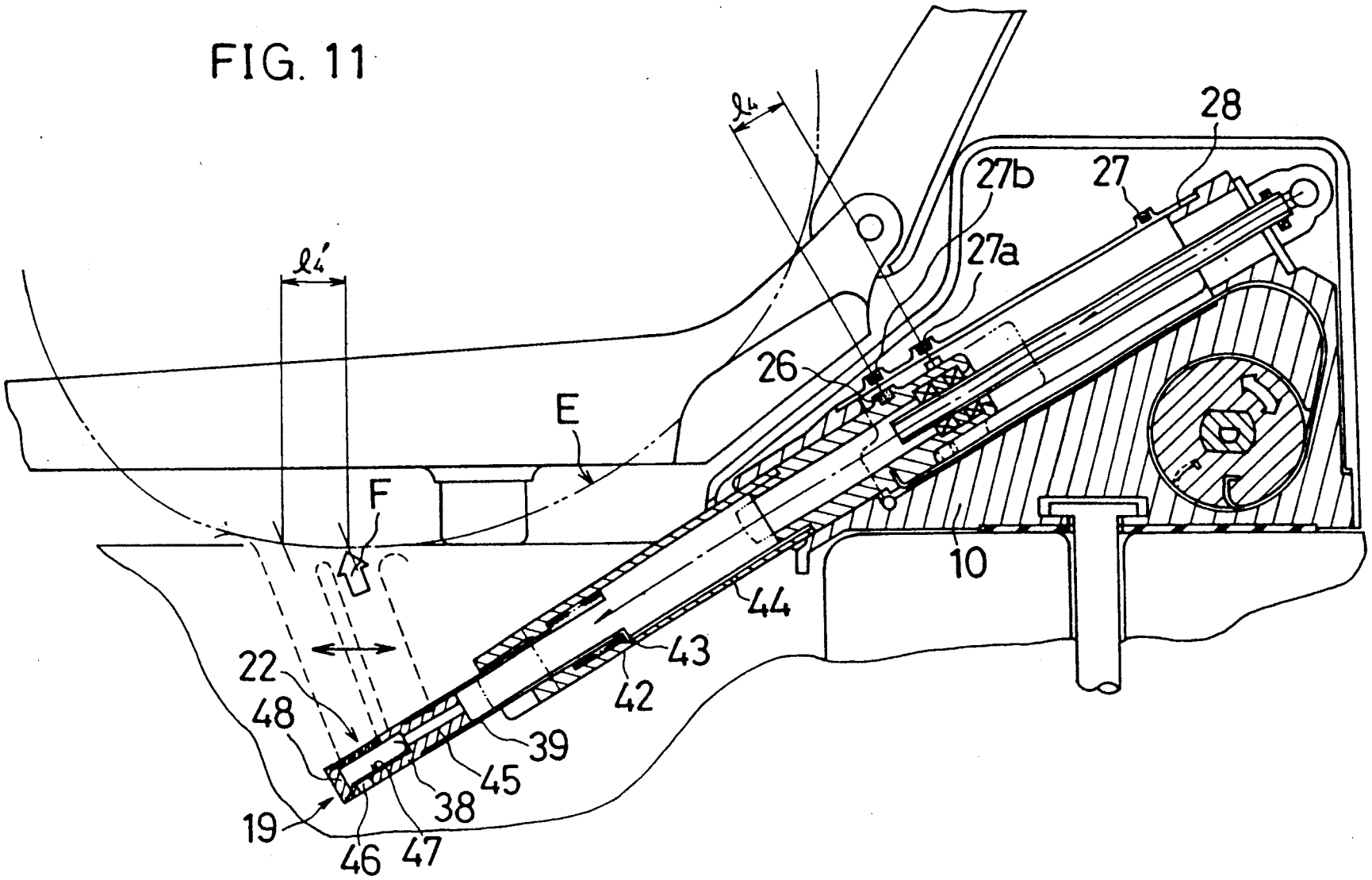
Figure 12:
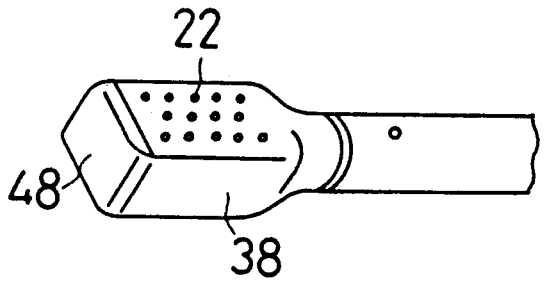
FIG. 12 is a view illustrating an appearance of the washing nozzle front end.
Figure 13:
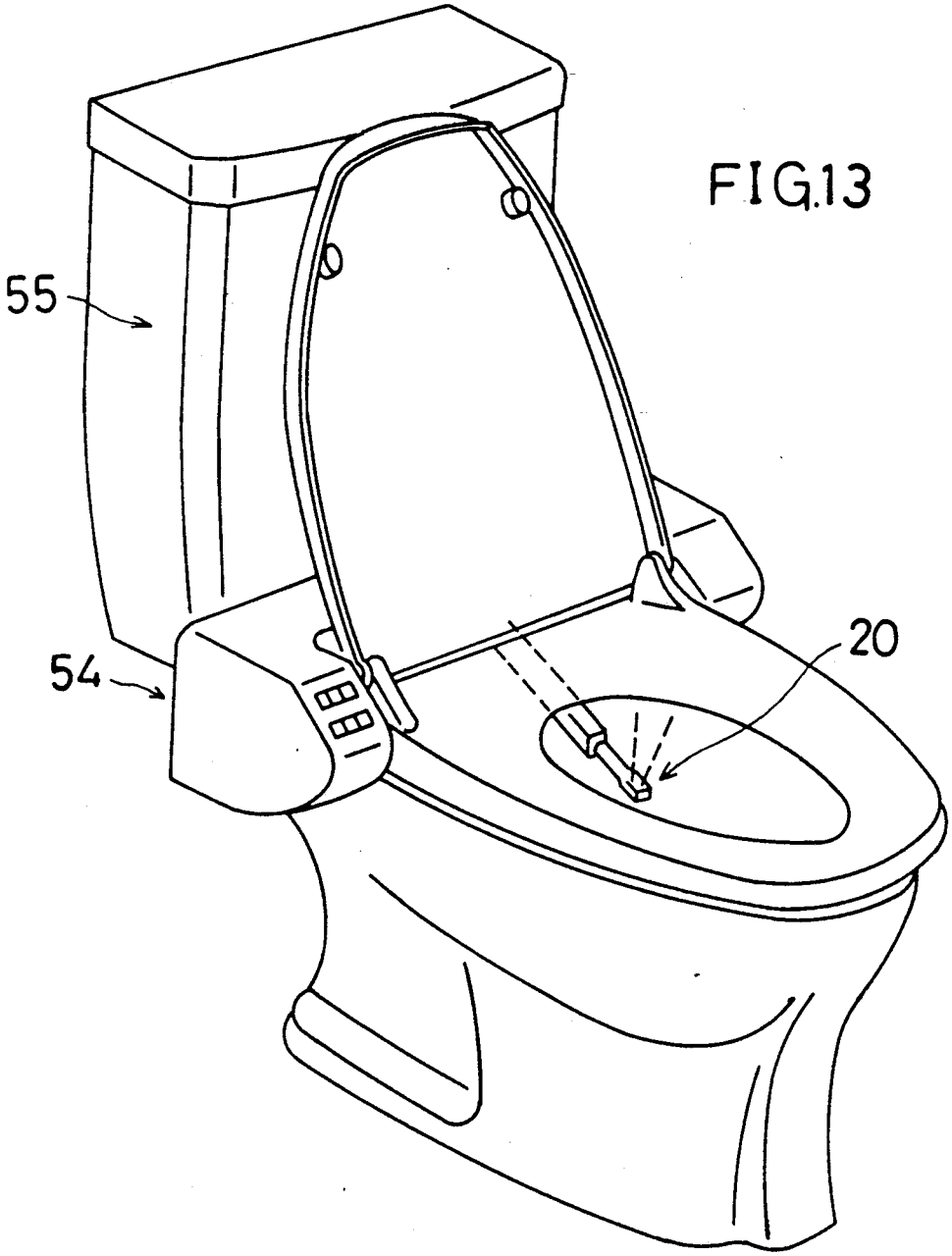
FIG. 13 is a view illustrating an appearance of a toilet bowl with a human private parts washing apparatus installed.
Figure 14:
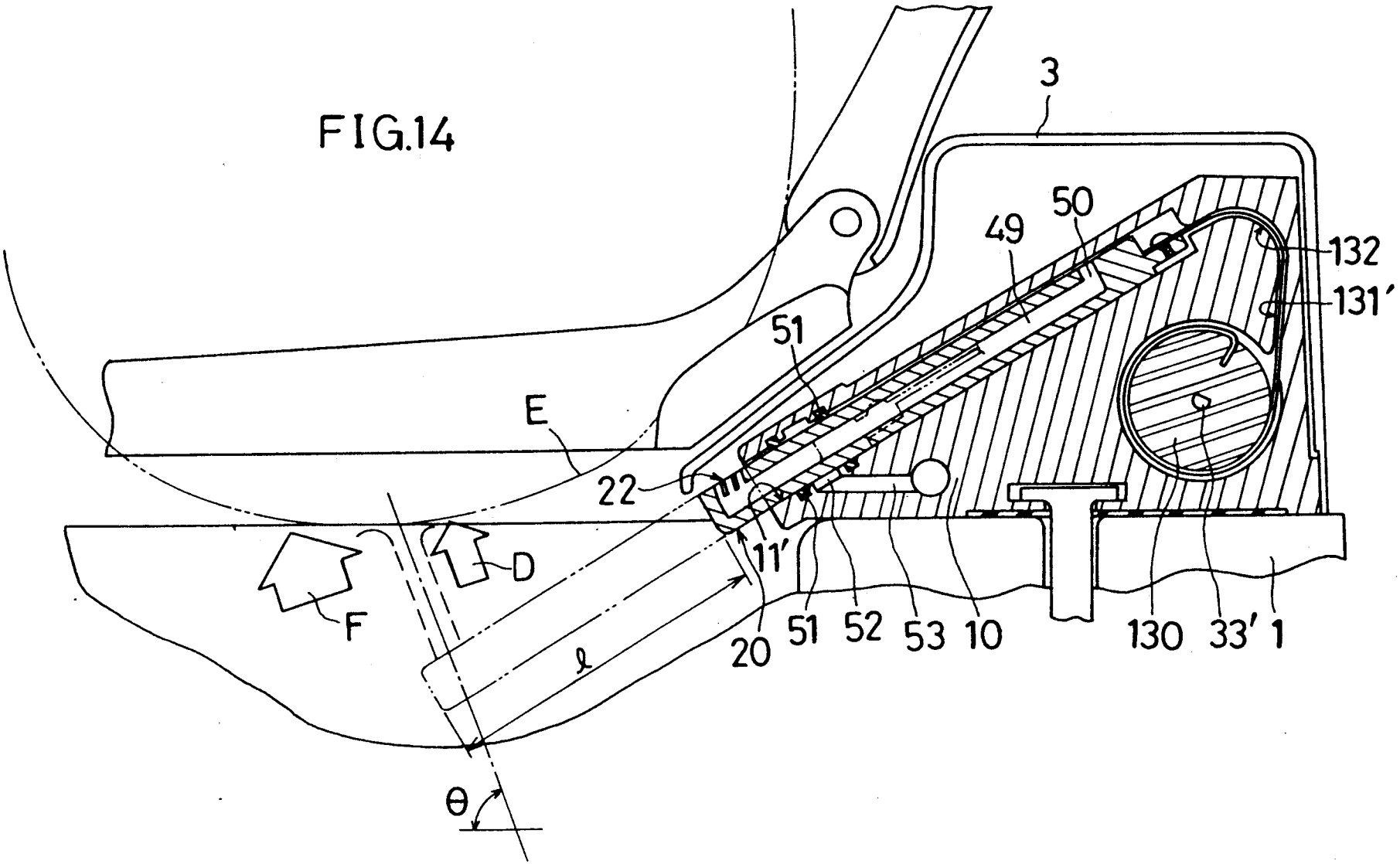
FIG. 14 is a cross sectional view of a conventional human private parts washing apparatus.

Turning now to FIG. 11, the drawing illustrates that the washing nozzle 20 is operated to slide back and forth additionally with respect to the bidet washing position. The washing nozzle 20 is advanced and retracted slidably with the washing nozzle driving means by activating and deactivating the reed switches **27*a* and 27*b* by a stroke of $l_4$ with respect to the bidet washing position. Here, the positions of the reed switches 27*a* and 27*b* corresponds the first-advancement position, i.e. the anus region washing position, and the end of the additional stroke respectively. Thus, the bidet washing with back and forth movement can be done over the additional stroke $l_4$ by operating the washing nozzle 20 between the reed switches 27*a* and 27*b*** in a certain period of time, and the feeling of the bidet washing can be improved.

What is claimed is:

1. A human private parts washing apparatus adapted to be installed on the top of a toilet bowl at the rear, comprising:

a washing water splashing means for splashing washing water to human private parts; and a washing water supplying means for supplying washing water from a washing water supply source, wherein said washing water splashing means comprises:

a nozzle supporter;

a washing water supply tube supported with said nozzle supporter, held in a manner declining obliquely and directed toward an inside of said toilet bowl, wherein a rear end of said washing water supply tube communicates with said washing water supply means;

a washing nozzle supported by said nozzle supporter, held slidably in a manner declining obliquely and directed toward the inside of said toilet bowl, wherein said washing nozzle accommodates said water supply tube in a rear end side thereof;

at least one sealing member disposed between said washing water supply tube and said washing nozzle, comprising means such that said sealing member seals between said washing water supply tube and said washing nozzle in a water-proof manner only immediately after a hydraulic pressure of said washing water is supplied in said washing water supply tube; and a washing nozzle driving means for driving said washing nozzle between a storage position and operation positions.

2. A human private parts washing apparatus according to claim 1, wherein said sealing member is installed in the rear side of said washing nozzle, and said washing water supply tube has a gradually reduced diameter at the rear side thereof on at least a portion thereof so as to form a clearance between itself and said sealing member when said washing nozzle is at said storage position and a diameter greater than said gradually reduced diameter at the front side so as to come into contact with said sealing member when said washing nozzle is at said operation positions.

3. A human private parts washing apparatus according to claim 1, wherein said washing nozzle driving means comprises, for operating said washing nozzle slidably back and forth between said storage position and said operation positions:

a rotary drum; and a cable disposed in a guide track, said cable being fixed at one end to said washing nozzle adjacent the end thereof, being fixed at another end to said rotary drum and being wound around said rotary drum.

4. A human private parts washing apparatus according to claim 1, wherein said washing nozzle comprises:

an outer nozzle operated slidably back and forth by a mechanical driving means; and an inner nozzle slidably stored in place inside said outer nozzle at the front side thereof, said inner nozzle having an orifice communicating splashing openings thereof with an inner space of said outer nozzle, said inner nozzle being slidable back and forth by the hydraulic pressure of supplied washing water.

5. A human private parts washing apparatus according to claim 4, wherein said mechanical driving means comprises, for operating said outer nozzle slidably back and forth between said storage position and said operation positions:

a rotary drum; and a cable disposed in a guide track, said cable being fixed at one end to said washing nozzle adjacent the end thereof, being fixed at the other end to said rotary drum, and being wound around said rotary drum.

6. A human private parts washing apparatus according to claim 4, wherein said sealing member is installed in the rear side of said outer nozzle, and said washing water supply tube has a gradually reduced diameter at the rear side thereof on at least a portion thereof so as to form a clearance between itself and said sealing member when said outer nozzle is at said storage position and a diameter greater than said gradually reduced diameter at the front side so as to come into contact with said sealing member when said outer nozzle is at said operation positions.

7. A human private parts washing apparatus adapted to be installed on the top of a toilet bowl at the rear, comprising:

a washing water splashing means for splashing washing water to human private parts; and a washing water supplying means for supplying washing water from a washing water supply source;

wherein said washing water splashing means comprises:

a nozzle supporter; and a washing nozzle supported by said nozzle supporter, held slidably in a manner declining obliquely and directed toward an inside of said toilet bowl, comprising an outer nozzle operated slidably back and forth by a mechanical driving means and an inner nozzle slidably stored in place inside said outer nozzle at a front side thereof, said inner nozzle having an orifice communicating splashing openings of said inner nozzle with an inner space of said outer nozzle, wherein said inner nozzle is operated slidably back and forth by a hydraulic pressure of supplied washing water.

8. A human private parts washing apparatus according to claim 7, wherein said mechanical driving means comprises, for operating said outer nozzle slidably back and forth between said storage position and said operation positions;

a rotary drum; and a cable disposed in a guide track, said cable being fixed at one end to said washing nozzle adjacent the end thereof, being fixed at the other end to said rotary drum and being wound around said rotary drum.

* * * * *

UNITED STATES PATENT AND TRADEMARK OFFICE

CERTIFICATE OF CORRECTION

PATENT NO. : 5,050,249

DATED : September 24, 1991

INVENTOR(S) : Hisanobu Takeda et al.

It is certified that error appears in the above-identified patent and that said Letters Patent is hereby corrected as shown below:

On title page, item [63],

The Related U.S. Application Data is incorrect, should be,

--Continuation of Ser. No. 196,430, May 20, 1988, abandoned--.

Signed and Sealed this

First Day of June, 1993

*Attest:*

Michael K. Kirk

MICHAEL K. KIRK

*Attesting Officer*

*Acting Commissioner of Patents and Trademarks*